US006892784B2

(12) United States Patent
Maas

(10) Patent No.: US 6,892,784 B2
(45) Date of Patent: May 17, 2005

(54) STABILIZED PORTABLE ROOM DIVIDER

(76) Inventor: Paul A. Maas, 1387 Woodland La., Riverwoods, IL (US) 60015

( * ) Notice: Subject to any disclaimer, the term of this patent is extended or adjusted under 35 U.S.C. 154(b) by 30 days.

(21) Appl. No.: 10/382,630

(22) Filed: Mar. 6, 2003

(65) Prior Publication Data

US 2004/0173325 A1 Sep. 9, 2004

(51) Int. Cl.[7] ..... A47G 5/00
(52) U.S. Cl. ..... 160/135; 52/239; 16/319
(58) Field of Search ..... 52/238.1, 239, 52/71; 16/319, 326, 330, 331, 35 D, 44; 160/135, 351, 233; 292/101, 103, 202, 204, 108; 256/24, 26

(56) References Cited

U.S. PATENT DOCUMENTS

| | | | | |
|---|---|---|---|---|
| 2,011,528 A | * | 8/1935 | Seay | 256/26 |
| 2,227,875 A | | 1/1941 | Boden | |
| 2,707,795 A | | 5/1955 | Skupas | |
| 3,472,545 A | * | 10/1969 | Berkowitz | 292/111 |
| 3,699,609 A | | 10/1972 | Spatz | |
| 4,407,045 A | | 10/1983 | Boothe | |
| 4,645,183 A | * | 2/1987 | Rattray et al. | 256/25 |
| 4,783,879 A | | 11/1988 | Weaver | |
| 5,052,076 A | | 10/1991 | Spaeth | |
| 5,272,848 A | * | 12/1993 | Maas | 52/238.1 |
| 5,450,694 A | * | 9/1995 | Goranson et al. | 52/71 |
| 6,009,930 A | * | 1/2000 | Jantschek | 160/135 |
| 6,195,838 B1 | | 3/2001 | Mains et al. | |
| 6,195,839 B1 | | 3/2001 | Patterson et al. | |
| 6,299,224 B1 | * | 10/2001 | Finkelstein | 292/241 |
| 6,357,077 B1 | | 3/2002 | Jones, Jr. et al. | |

OTHER PUBLICATIONS

Screenflex Portable Partitions, Inc., "Portable Partition Systems for Your Facility," brochure, 12 pages.

* cited by examiner

*Primary Examiner*—Blair M. Johnson
(74) *Attorney, Agent, or Firm*—George E. Haas; Quarles & Brady LLP

(57) ABSTRACT

A portable room divider includes a plurality of wall panels interconnected by hinges. Each pair of adjacent wall panels also is connected by a position control hinge which provides resistance to pivotal motion between those wall panels. As a result, a force in excess of a given magnitude must be applied to pivot those wall panels, which provides stability to the room divider in use. Feet project laterally from both side of some of the wall panels and self-leveling casters are mounted to the feet. A spring biasing mechanism forces each caster against the floor to compensate for irregularities in the floor surface. Thus, the self-leveling casters are maintained against the floor to further stabilize the room divider when in use. A mechanism is provided to connect and join together multiple room dividers in a series.

14 Claims, 2 Drawing Sheets

STABILIZED PORTABLE ROOM DIVIDER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates generally to room dividers, more particularly, to a portable, freestanding room dividers.

2. Description of the Related Art

There are times that it is desired to divide large areas, such as rooms or halls, into smaller more private areas. One method of doing this is by movable wall panels which are suspended from and move on tracks attached to the ceiling and/or floor. This method is relatively expensive and it is inflexible as the space only can be divided according to the pattern of tracks.

Another method for dividing large rooms into smaller private areas is to use movable freestanding screens. This method is relatively inexpensive and permits the formation of areas of a wide variety of sizes and shapes. However, many freestanding screen must be placed in a zigzag pattern in order to stand by themselves. That zigzag pattern consumes an amount of otherwise useable floor space. In addition those screens present storage and handling problems.

U.S. Pat. No. 5,272,848 discloses a portable room divider which has a plurality of hinged wall panels positioned between a pair of end members. The wall panels are supported by a plurality of casters mounted on feet which project laterally from the bottom of the wall panels. The end members also are supported by casters. The combination of wall panels and end members can be folded into a compact configuration for easy movement and storage. The hinged wall panels can be unfolded to form a straight wall which is supported is a stable manner by the casters on the feet and end members. A hinged junction between two adjacent wall panels can be bent at an angle to form a corner of the temporary wall, for example a 90° corner for a rectangular subdivided area.

To further stabilize an extended portable room divider, removable clips were furnished to attach at the upper edges of two adjacent panels. Each rigid clip bridged the hinge joint to secure the angle between the panels. A set of clips for 90°, 135° and 180° panel angles were provided. Although the rigid clips worked well at preventing the installed panels from bending at the hinges, the placement and removal of the clips increased the time required to set-up and remove the portable room divider. Between use, the clips had to be stored in a container which had to be keep with the room divider and even with the container individual clips became lost over time.

This portable room divider described in the aforementioned patent functioned extremely well on relatively level floors. However, the floors in some new and many older buildings tend to be uneven with humps and depressions. When the portable room divider is unfolded in such buildings, some of the casters do not touch the low sections of the floor and thus do not properly support the associated wall panels. When a caster does not touch the floor, the associated wall panel will wobble with the slightest lateral force thereby rendering the entire room divider unstable. The obvious solution is to place shims between the casters and the floor, but this required additional set-up and removal steps. In addition, the shims have to be stored when not in use and located each time the portable room divider is needed.

There is a need for a more convenient technique for stabilizing a portable, freestanding room divider under a variety of floor conditions.

SUMMARY OF THE INVENTION

A portable, freestanding room divider is provided to partition large rooms into smaller areas. This room divider comprises a plurality of hinged wall panels, which can be folded against one another for compact storage and unfolded to form a wall.

The wall panels include a first wall panel, a last wall panel, and at least one intermediate wall panel. A plurality of hinges connect the first wall panel to an intermediate panel, the last wall panel to an intermediate panel, and each intermediate panel to two of the plurality of wall panels. A plurality of position control hinges are provided with each one being attached between two of the wall panels, Each position control hinge has a pair of surfaces which abut in a manner that resists pivotal motion between the attached wall panels. The position control hinge prevents low magnitude forces acting on the wall panels from causing one wall panel to pivot with respect to an adjacent wall panel, thus aiding the stability of the room divider.

A plurality of feet project outward from at least some of the plurality of wall panels. A plurality of self-leveling casters is moveably connected to the plurality of feet for supporting the wall panels on a floor of a room. Each caster is biased with respect to the associated foot by a spring to maintain the caster in contact with the floor. Therefore, even on an irregular, uneven floor having depressions or humps, all the casters will be in contact with the floor surface and continually bear their proportional share of the partition's weight, which further aids the stability of the room divider.

DESCRIPTION OF THE PREFERRED EMBODIMENT

Figures 1, 2, 8:
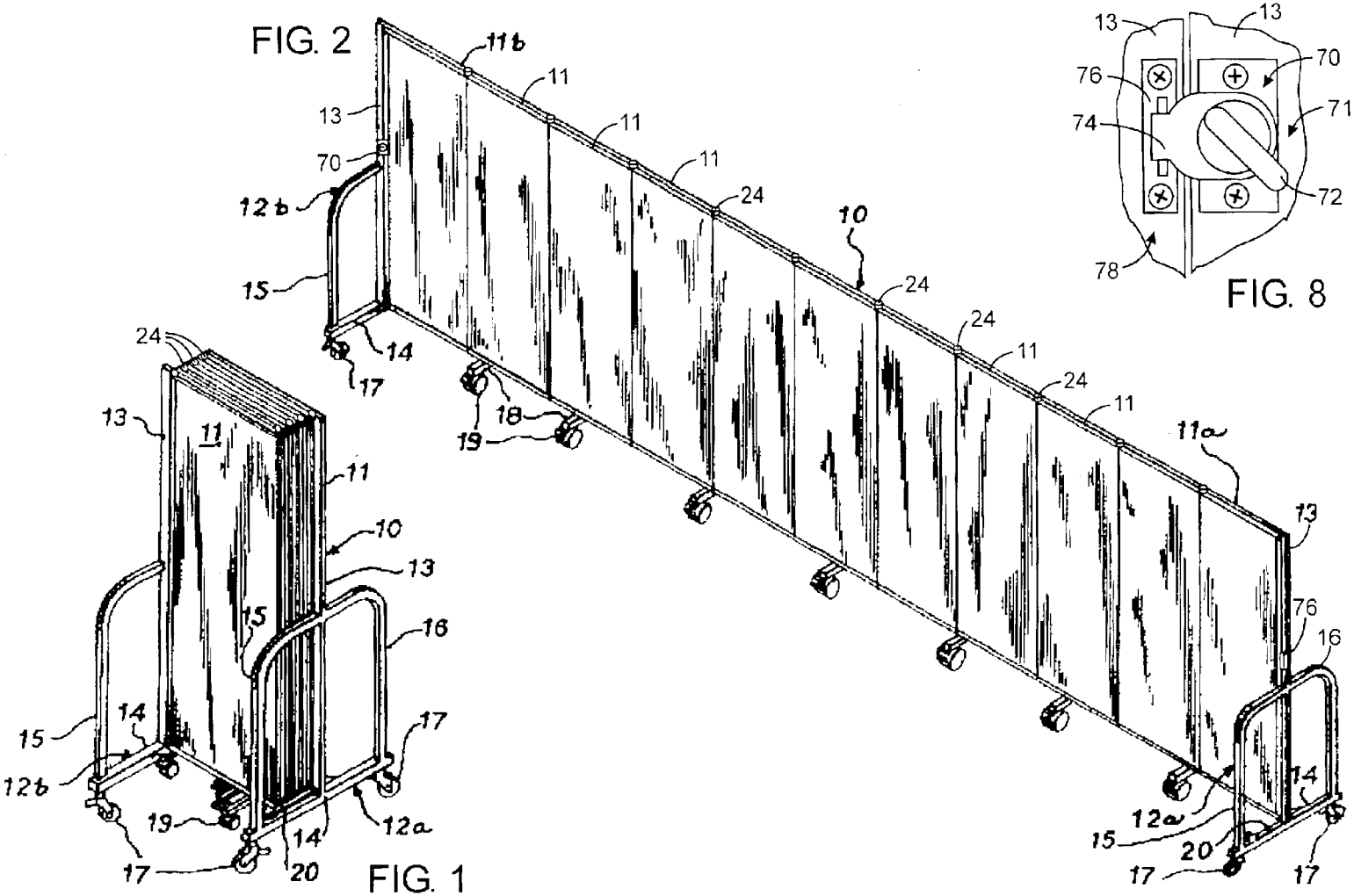
FIG. 1 is a perspective view of a portable, freestanding, room divider according to the present invention with the panels folded storage and transportation.
FIG. 2 is a perspective view of the room divider of FIG. 1 with the wall panels unfolded to form a straight wall.
FIG. 8 illustrates a multi-unit connector fastening two abutting room dividers together.
Figure 3:
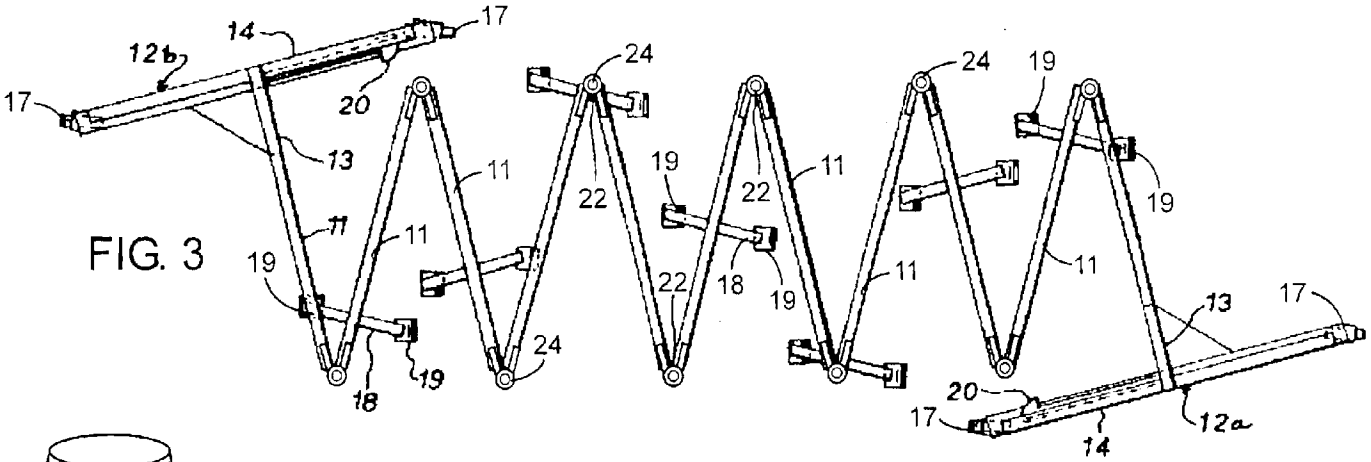
FIG. 3 is a top view of the embodiment of FIG. 1 partially unfolded.

With reference to FIG. 1, a room divider 10 with eleven wall panels 11 is held in a fully folded configuration by a clasp 20 for storage and transportation prior to use. The room divider 10 is shown in use in FIG. 2 with the eleven wall panels 11 unfolded to form a straight wall. Alternatively, walls of various geometric shapes can be created by forming acute angles between adjacent wall panels 11. Although an exemplary room divider 10 has eleven wall panels, the number of wall panels can vary to provide room dividers of different lengths. FIG. 3 illustrates the wall panels 11 partially unfolded as they might appear between the fully folded and unfolded states.

With particular reference to FIGS. 1 and 2, the first and last panels 11*a* and 11*b*, respectively, are attached to the middle of end members 12*a* and 12*b*, respectively. The end members 12*a* and 12*b* have a vertical post 13, a horizontal base bar 14 and a pair of curved posts 15 and 16 connecting the base bar 14 to the vertical post 13. The vertical post 13 of each end member 12*a* and 12*b* is rigidly attached to a vertical edge of the associated first or last panel 11*a* or 11*b*. The end members 12*a* and 12*b* are wider than the panels 11 and their orthogonal orientation provides support for the unfolded panels 11. The curved posts 15 and 16 serve as convenient handles for moving the room divider 10. The base bar 14 of the end members 12*a* and 12*b* has casters 17 with wheels so that the room divider 10 is portable and can be moved easily from one location to another.

Referring to FIG. 3, each wall panel 11 is connected to each immediately adjacent wall panel by a separate hinge 22, which extends substantially the entire height of the panels. This enables the wall panels to be readily folded for storage as seen in FIG. 1 and unfolded to form a wall as seen in FIG. 2. The hinge 22 permits an angle from 0° to 180° to be formed in the wall between two adjacent panels. The full height hinge 22 provides stability at the junction between adjacent wall panels and resists flexing of the portable room divider at that junction.

For additional stability, a panel position control hinge 24 is located at the top of each junction between two wall panels 11. The position control hinges 24 provide resistance to pivotal motion between adjacent wall panels so that, once positioned to divide a room, the wall panels 11 will not pivot about the hinged junction due to a slight amount of force. This resistance further stabilizes the room divider 10.

Figure 5:
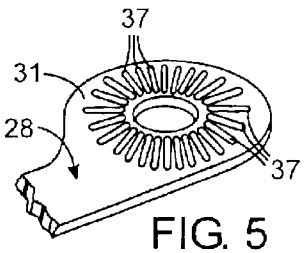
FIG. 5 show indentations in one component of the position control hinge.
Figure 4:
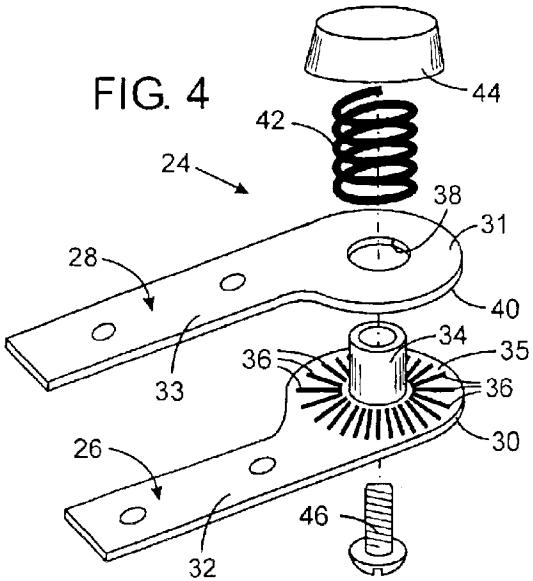
FIG. 4 is an exploded view of a position control hinge which couples two adjacent wall panels.

FIG. 4 illustrates the details of each panel position control hinge 24 which includes a pair of hinge leaves 26 and 28. Each hinge leaf 26 and 28 has a circular portion 30 or 31 from which a leg 32 or 33 respectively projects and each leg is attached by screws to the top edge of a different wall panel 11. The illustrated panel position control hinge 24 depicts the orientation of the hinge leaf 26 and 28 when the two wall panels are folded side-by-side as in FIG. 1. The first hinge leaf 26 has an integral tube 34 projecting upward at the center of the circular portion 30 and has a plurality of ribs 36 on its upper surface 35 extending radially around the integral tube. The second hinge leaf 28 has an aperture 38 at the center of its circular portion 31 through which the tube 34 of the first hinge leaf 26 extends in the assembled position control hinge 24. As shown in FIG. 5, the second hinge leaf 28 has a plurality of indentations 40 extending radially around the aperture 38 on the lower surface of its circular portion 31. In the assembled position control hinge 24, the two hinge leaves abut with the ribs 36 on first hinge leaf 26 being received in the indentations 40 in the second hinge leaf 28. This engagement of the ribs in the indentations resists movement between the first and second hinge leaves 26 and 28 and thus pivoting of the hinge joint between the adjacent wall panels 11. As a result of that resistance movement of the hinge occurs in a controlled manner.

A spring 42 is located between the upper surface of the second hinge leaf 28 and a cap 44 that engages the end of the tube 34 which projects through the aperture 38 in the second hinge leaf 28. A machine screw 46 extends through the tube 34 and threads into an aperture in the cap 44 to hold the components of the position control hinge 24 together.

A gap exists in the assembled position control hinge 24 between second hinge leaf 28 and the cap 44 which allows the second hinge leaf to move along the tube 34. Thus as the first and second hinge leaves 26 and 28 rotate about the axis of tube 34 the ribs 36 and indentations 40 on the hinge leaves ride up and down over each other against the force of the spring 42. This action provides resistance to such rotation and thus to pivotal motion between the wall panels 11 to which the position control hinge 24 is attached. To increase the amount of such resistance, additional position control hinges can be placed at the bottom of each junction between adjacent wall panels 11.

As seen in FIGS. 2 and 3, a foot 18 is provided at the bottom of some of the wall panels 11. Each foot 18 extends orthogonally outward from the associated wall panel 11. A separate caster 19 is swivel mounted near the outer ends of each foot 18. The feet 18 and casters 19 help support the room divider 10 when the wall panels are unfurled. Additional casters 17 are provided near the ends of the horizontal base bars 14 of the end members 12*a* and 12*b*. These latter casters 17 have the same general design as the wall panel casters 19, except that the ends casters 17 also have a conventional mechanism for locking the wheels. A wheel locking mechanism also can be provided on the wall panel casters 19.

Figure 6:
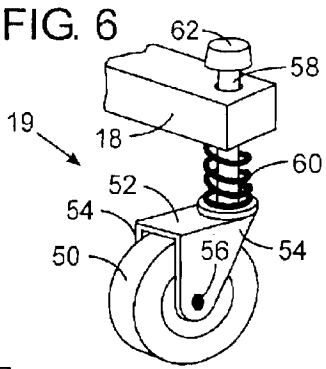
FIG. 6 is an enlarged view showing a self-leveling caster attached to a wall panel.

The casters 17 and 19 self adjust and level to variation in the floor on which the room divider 10 is located. With reference to FIG. 6, each self-leveling caster 19 has a wheel 50 that rotates about an axel pin 56 extending between a pair of spaced-apart plates 54 of a caster bracket 52. Alternatively, a ball type caster could be used in which a ball, held captive in a bracket, rides on the floor of the room. A swivel pin 58 projects upward from the caster bracket 52 and extends through an aperture in the end section of a wall panel foot 18. The swivel pin also extends through a coil spring 60 located between the foot 18 and the caster bracket 52 biasing those latter components apart. A cap is secured to the end of the swivel pin 58 which projects through the wall panel foot 18.

Figure 7:
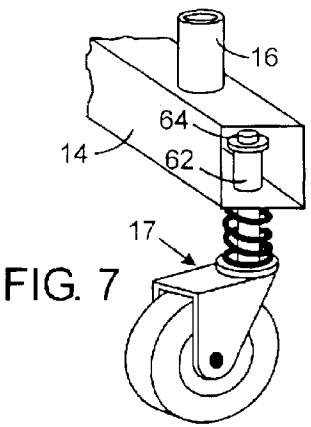
FIG. 7 is an enlarged view showing a self-leveling caster attached to an end member.

FIG. 7 illustrates the mounting of a caster 17 on the horizontal base bar 14 of one of the end members 12*a* or 12*b*. Here a bushing 62 is welded in an aperture extending into the hollow base bar 14 to receive the swivel pin 58 of the caster. A snap ring 64 fits in a groove at the end of the swivel pin 58 to lock the caster in the bushing 62. The caster 17 is similar in design to caster 19, but may differ in size.

When the room divider 10 is unfolded to partition a room, the coil springs 60 ensure that each wheel 50 contacts the floor in spite of any undulations in the floor surface. The spring force is selected whereby on a level floor, the weight of the wall panels 11 slightly compresses the coil spring 60 so that the caster 19 is at an intermediate travel position with respect to the foot 18. In other words the caster 19 is not at either a fully raised or fully lowered position and thus can accommodate depressed and humped areas of an uneven floor. Because the set of casters 19 on the room divider 10 self-adjust to compensate for non-flat floors, the wall panels 11 always are supported by the casters and cannot easily wobble.

In the folded state in FIG. 1, the room divider 10 is easily moved into an area to be divided into one or more predetermined private areas. The clasps 20 on the end members 12*a* and 12*b* are then flexed outwardly and the panels 11 unfolded to form a wall of the desired shape. Once the panels are properly positioned to subdivide the room, such as in FIG. 2, the wheels of the casters 17 on the end members 12*a* and 12*b* are locked to anchor the ends of the wall. If desired, the casters 19 on the panels also can be provided with wheel locks to help immobilize the thus formed wall.

When two separate room dividers 10 abut end-to-end, multi-unit connectors 70 on the vertical posts 13 are interlocked to secure the room dividers 10 together. With reference to FIG. 6, a lever assembly is attached by screws to the vertical post 13 on one room divider 71 and has a lever 72 connected by a cam mechanism to a rotatable hook 74. A catch 76 is attached by screws to the vertical post 13 on the abutting room divider 78. Pivoting the lever 72 rotates the hook 74 behind the catch 76. Further rotation of the lever 72 draws the hook toward its room divider 71 and against the catch 76, thereby securing the two room dividers 71 and 78 together. This securing together can be repeated so as to join many room dividers in series.

When it is desired to disassemble the wall and store the wall panels 11, the wheel locks on the casters 17, and optionally casters 19, are unlocked. The hinged panels 11 then are folded into the configuration shown in FIG. 1 and the clasps 20 retain the panels 11 in that folded state.

It will be apparent to those skilled in the art from the foregoing description and the drawings that the present invention provides a very convenient, inexpensive and flexible means for dividing large areas into smaller more private areas. The walls that are formed can be straight, angled or partially folded. The walls can be the width of a single wall panel or any multiple thereof and within limits they can extend in any direction. The self-adjusting casters 17 and 19 and position control hinges 24 provide increased stability to the room divider 10 in the unfolded state.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

I claim:

1. A freestanding room divider comprising a plurality of wall panels including a first wall panel, a last wall panel, and at least one intermediate wall panel;

a plurality hinges which connect the first wall panel to an intermediate panel, the last wall panel to an intermediate panel, and each intermediate panel to two of the plurality of wall panels, wherein each hinge extends alone and connected to vertical edges of two adjacent ones of the plurality of wall panels;

plurality of position control hinges each connected between two of the plurality of wall panels and having a pair of abutting rough surfaces that resist pivotal motion between those two wall panels;

a plurality of feet projecting outward from at least some of the plurality of wall panels; and a plurality of self-leveling casters moveably connected to the plurality of feet for supporting the plurality of wall panels on a floor of a room, each caster being biased with respect to the associated foot by a spring to maintain the caster in contact with the floor.

2. The freestanding room divider as recited in claim 1 wherein each of the plurality of position control hinges comprises:

a first hinge leaf connected to one of the wall panels and having a first surface on which a plurality of detents are formed;

a second hinge leaf connected to another wall panel and having a second surface with elements that engage the plurality of detents on the first hinge leaf; and a spring which biases the first surface of the first hinge leaf against the second surface of the second hinge leaf.

3. The freestanding room divider as recited in claim 1 wherein each of the plurality of position control hinges comprises:

a first hinge leaf with a first circular portion from which extends a leg that is attached to one of the wall panels, a tube projecting from a first surface of the first circular portion and a plurality of ribs on the first surface extending radially around the tube on the first surface;

a second hinge leaf with a second circular portion from which extends another leg that is attached to another wall panel, the second circular portion has an aperture through which the tube extends and has a second surface with a plurality of indentations extending radially around the aperture; and a spring biasing one of the first hinge leaf and second hinge leaf so that the first surface abuts the second surface wherein the plurality of ribs engages the plurality of indentations, the spring permitting motion of the first surface against the second surface.

4. The freestanding room divider as recited in claim 1 wherein each of the plurality of self-leveling casters comprises:

a bracket;

a wheel rotatably connected to the bracket; and a spring biasing the bracket with respect to one of the plurality of feet and toward the floor.

5. The freestanding room divider as recited in claim 1 wherein each of the plurality of self-leveling casters comprises:

a bracket having a swivel pin extending through an aperture in one of the plurality of feet;

a wheel rotatably connected to the bracket; and a coil spring extending around the swivel pin and biasing the bracket away from the one foot.

6. The freestanding room divider as recited in claim 5 wherein each of the plurality of self-leveling casters further comprises a cap secured to an end of the swivel pin that extends through the aperture in the one foot.

7. The freestanding room divider as recited in claim 1 further comprising a connector for securing the freestanding room divider to another freestanding room divider.

8. The freestanding room divider as recited in claim 1 further comprising:

a first end member connected to the first wall panel and extending transversely to a plane of the first wall panel so as to lend stability to the first wall panel; and a second end member connected to the last wall panel and extending transversely to a plane of the last wall panel so as to lend stability to the last wall panel.

9. A freestanding room divider comprising a plurality of wall panels including a first wall panel, a last wall panel, and at least one intermediate wall panel;

a plurality of hinges connecting the plurality of wall panels together with each hinge extending along and connected to vertical edges of two adjacent ones of the plurality of wall panels, wherein the first wall panel is connected to an intermediate panel, the last wall panel is connected to an intermediate panel, and each intermediate panel is connected to two of the plurality of wall panels;

a plurality of position control hinges each connected to two of the plurality of wall panels and providing resistance to pivotal motion between those two wall panels;

a plurality of feet projecting outward from at least some of the plurality of wall panels; and a plurality of casters moveably connected to the plurality of feet for supporting the plurality of wall panels.

10. The freestanding room divider as recited in claim 9 wherein each of the plurality of casters is biased with respect to the associated foot by a spring to maintain the caster in contact with a floor of a room in which the freestanding room divider is located thereby lending stability to the plurality of wall panels while in use to divide a room.

11. The freestanding room divider as recited in claim 9 wherein each of the plurality of casters comprises:

a bracket having a swivel pin extending through an aperture in one of the plurality of feet;

a wheel rotatably connected to the bracket; and a coil spring extending around the swivel pin and biasing the bracket away from the one foot toward the floor.

12. The freestanding room divider as recited in claim 9 further comprising:

a first end member connected to the first wall panel and extending transversely to a plane of the first wall panel so as to lend stability to the first wall panel; and a second end member connected to the last wall panel and extending transversely to a plane of the last wall panel so as to lend stability to the last wall panel.

13. The freestanding room divider as recited in claim 9 wherein each of the plurality of position control hinges comprises:

a first hinge leaf connected to one of the wall panels and having a first surface on which a plurality of detents are formed;

a second hinge leaf connected to another wall panel and having a second surface with elements that engage the plurality of detents on the first hinge leaf; and a spring applying a bias force which tends to hold the first surface of the first hinge leaf against the second surface of the second hinge leaf.

14. The freestanding room divider as recited in claim 9 wherein each of the plurality of position control hinges comprises:

a first hinge leaf with a first circular portion from which extends a leg attached to one of the wall panels, a tube projecting from a first surface of the first circular portion and a plurality of ribs on the first surface extending radially around the tube;

a second hinge leaf with a second circular portion from which extends another leg attached to another wall panel, the second circular portion has an aperture through which the tube extends and has a second surface with a plurality of indentations extending radially around the aperture and meshing with the first plurality of ribs; and a spring biasing one of the first hinge leaf and second hinge leaf so that the first surface abuts the second surface wherein the plurality of ribs engages the plurality of indentations, the spring permitting motion of the first surface against the second surface.

* * * * *

UNITED STATES PATENT AND TRADEMARK OFFICE

CERTIFICATE OF CORRECTION

PATENT NO. : 6,892,784 B2
DATED : May 17, 2005
INVENTOR(S) : Paul A. Maas

It is certified that error appears in the above-identified patent and that said Letters Patent is hereby corrected as shown below:

Column 5,
Line 55, change “alone” to -- along --.

Signed and Sealed this

Sixteenth Day of August, 2005

JON W. DUDAS
*Director of the United States Patent and Trademark Office*